United States Patent [19]

Uozumi et al.

[11] 4,264,707

[45] Apr. 28, 1981

[54] LIGHT-SENSITIVE PHOTOGRAPHIC MATERIALS WITH IMPROVED ANTISTATIC LAYERS

[75] Inventors: Takahiro Uozumi; Tohru Kobayashi; Koichi Nagayasu, all of Hino, Japan

[73] Assignee: Konishiroku Photo Industry Co., Ltd., Tokyo, Japan

[21] Appl. No.: 951,305

[22] Filed: Oct. 13, 1978

[30] Foreign Application Priority Data

Oct. 21, 1977 [JP] Japan ..... 52-126577

[51] Int. Cl.[3] ..... G03C 1/78; G03C 1/96

[52] U.S. Cl. ..... 430/275; 430/278; 430/524; 430/526; 430/523; 430/527; 430/530; 430/631

[58] Field of Search ..... 96/87 A, 114.2, 67; 252/313 R; 430/524, 526, 527, 530, 631, 275, 278, 523

[56] References Cited

U.S. PATENT DOCUMENTS

| | | | |
|---|---|---|---|
| 1,471,592 | 10/1923 | Coberly | 96/87 A |
| 2,763,620 | 9/1956 | Bugosh | 252/313 |
| 2,970,966 | 2/1961 | Hoeksira | 252/313 |
| 3,020,242 | 2/1962 | McChatney et al. | 252/442 |
| 3,207,578 | 9/1965 | Brown et al. | 23/143 |
| 3,208,849 | 9/1965 | Steinle | 430/526 X |
| 3,340,205 | 9/1967 | Hayes et al. | 252/313 |
| 3,535,268 | 10/1970 | Hayes | 252/313 |
| 3,729,020 | 10/1973 | Verburg | 96/87 A X |
| 3,874,878 | 4/1975 | Rasch et al. | 430/526 X |
| 3,938,999 | 2/1976 | Yoheyama et al. | 96/87 A X |
| 3,951,662 | 4/1976 | Chiba et al. | 96/87 A X |
| 3,964,906 | 6/1976 | Kenney | 430/275 |
| 4,126,467 | 11/1978 | Miyazako et al. | 96/87 A |

FOREIGN PATENT DOCUMENTS

| | | | |
|---|---|---|---|
| 4046272 | 9/1977 | Japan . | |
| 1174648 | 12/1969 | United Kingdom | 430/530 |
| 1440194 | 6/1976 | United Kingdom | 430/530 |

OTHER PUBLICATIONS

Gayner; Frank, Concise Dictionary of Science; 1968; pp. 207, 452.

Webster's New Collegiate Dictionary, G & C Merriam Co., 1977, pp. 477, 1105.

Mellor; A Comprehensive Treatise on Inorg. & Theoretical Chem. 1924, pp. 276, 277.

Sienko and Plane; Chemistry, 1957, pp. 230, 231.

Yoldas, B. E. Alumina Gels That Form Porous Gels., J. Materials Sc. 10, pp. 1856–1860, 1975.

Kirk-Othmer, *Encyclopedia of Chemical Technology,* 3rd. Edition, vol. 3, pp. 149–183, 1978.

Kirk-Othmer, *Encyclopedia of Chemical Technology,* 3rd Edition, vol. 2, pp. 219–244, 1978.

*Primary Examiner*—Edward C. Kimlin

*Attorney, Agent, or Firm*—Frishauf, Holtz, Goodman & Woodward

[57] ABSTRACT

A photographic material comprising a light sensitive photographic layer and a support having thereon in order a layer containing alumina sol including colloidal particles and an electrolyte and a layer containing a hydrophobic polymer.

8 Claims, No Drawings

LIGHT-SENSITIVE PHOTOGRAPHIC MATERIALS WITH IMPROVED ANTISTATIC LAYERS

This invention relates to an improved light-sensitive photographic material.

More particularly, it is concerned with a light-sensitive photographic material having an improved antistatic layer.

A light-sensitive photographic material is generally composed of a support having an electric insulation property and photographic element layers such as a photographic emulsion layer, an interlayer, a filter layer, a protective layer, a backing layer and the like. Light-sensitive photographic materials are charged with static electricity due to friction or peeling between the said materials themselves or between them and other materials during production steps or use, and at the time of its discharge the light-sensitive photographic layer is sensitized and static marks are formed upon development and various drawbacks such as sticking of dust may arise. There have been hitherto proposed various processes in order to prevent such drawbacks. One of the well-known and frequently utilized processes is to coat a layer containing a hygroscopic substance or an electro-conductive substance over the reverse side (the side having no light-sensitive photographic layer) of a light-sensitive photographic material so that the said light-sensitive photographic material is provided with electroconductivity to prevent accumulation of static electricity.

However, most such electroconductive layers are hydrophilic and, particularly, when they are applied to a light-sensitive silver halide photographic material, there are produced various undesirable results; for example, there arises such adhesion hindrance as mutual adhesion of light-sensitive silver halide photographic materials at a high humidity; an antistatic layer is dissolved into the developing solution upon development to combine with other substances present in the developing solution, which leads to formation of turbidity or sludge; or other substances are absorbed in the reverse side to produce uneveness, together with loss of the antistatic layer upon development.

Against these undesirable results there have been heretofore attempted various preventive measures. For instance, it is know against adhesion hindrance to reduce the contact area of a backing layer with other surfaces or include in a backing layer a matting agent, i.e. fine grains of silica, polymethylmethacrylate and the like for the present mutual adhesion, as well as fluorine-containing surfactants. In order to prevent such adverse effects as production of turbidity or sludge in a developing solution, adsorption of other substances in the reverse side of a light-sensitive photographic material and so on, an electroconductive substance should be selected taking into consideration the composition of the developing bath so as to diminish possible production of such adverse effects as far as practicable and, therefore, there is a very poor availability of hydrophilic, electroconductive substances. In addition, no particular attention has been paid to the antistatic layer after development, since there is no possibility of developing serious static marks. No studies are being carried out to investigate such adversed effects as sticking of dust and the like.

As explained above, the antistatic layer of light-sensitive photographic materials, particularly light-sensitive silver halide photographic materials should not only have an antistatic property but simultaneously satisfy other accompanying problems as stated above. However, it was very difficult to solve all these problems and the prior art could only solve parts of such problems.

There is known a process in which an inorganic metal oxide sol is coated and adhered onto a support. But, the antistatic layer according to this process has a weak film and a poor abrasion resistance.

Also, a process has been suggested wherein an evaporated film is coated to provide electroconductivity. However, the process is expensive in processing cost and is technically difficult, as compared with the roll-coating system. Moreover, the photographic properties of light-sensitive photographic materials may be adversely affected depending upon the metal to be evaporated and satisfactory abrasion resistance is not available and thus this process is not always regarded as suitable for all light-sensitive photographic materials.

As discussed hereinabove, none of the well-known techniques have been completely satisfactory.

It is, accordingly, an object of this invention to provide a light-sensitive photographic material having an antistatic layer which is difficult to adhere to other films even in an environment having high humidity.

Another object of this invention is to provide a light-sensitive photographic material having an antistatic layer which possesses the good film properties of not being susceptible to abrasion and of not being peeled off before, during and after high temperature rapid processing.

A further object of this invention is to provide a light-sensitive photographic material having an antistatic layer which does not dissolve in the developing solution, and does not form turbidity and sludge.

A still further object of this invention is to provide a light-sensitive photographic material having an antistatic layer which does not adversely affect photographic properties of the said material.

These objects can be satisfactorily attained by the present light-sensitive photographic material which comprises a light-sensitive photographic layer and a support having thereon in order a layer containing alumina sol (hereinafter cited as a first layer) and a layer containing a hydrophobic polymer (hereinafter cited as a second layer).

The alumina sol employed in this invention involves colloidal particles, which are mainly composed of aluminium oxide and an electrolyte.

The colloid particles, in addition to the afore-mentioned aluminum oxide, may include water contained therein which forms a hydrate or which is adsorbed thereon, or other substance contained therein or adsorbed thereon in such an amount that the inherent properties of the colloid particles are not adversely affected.

The colloidal particles in this invention are preferably of an average grain size ranging from $0.1\mu$ to $0.02\mu$. The amount of the colloidal particles to be coated is preferably of $5\sim500$ mg. per $m^2$.

The alumina sol which may be employed in this invention, can be prepared according to various processes well-known in the art, for example, by the method disclosed in Japanese Patent Publication No. 20150/1964. More illustratively, the sol may be prepared, for example, by heating metallic aluminium powder in (i) an aqueous solution of hydrochloric acid, or (ii) in acetic acid, or (iii) in an aqueous solution of nitric acid in a similar manner. Also, the sol is easily available from commercial products. Then, ordinary commercial products may include an acid, e.g. hydrochloric acid or acetic acid.

The alumina sol in this invention can exert excellent effects because of the incorporated electrolyte, which excellent effects are not obtained when the alumina sol does not contain the electrolyte. Although the mechanism of the electrolyte is not fully understood, it is believed that a highly stable antistatic layer will be formed by the electrolyte being adsorbed and maintained on the surface of colloidal particles.

As the electrolyte which is to be incorporated in alumina sol, there may be mentioned an inorganic acid such as hydrochloric acid, nitric acid, sulfuric acid or phosphoric acid; an organic acid such as an aliphatic carboxylic acid, e.g. formic acid, acetic acid or propionic acid or an aromatic carboxylic acid, e.g. cinnamic acid; an alkali metal hydroxide or salt such as sodium chloride, sodium acetate or sodium silicate; and the like. Inorganic acids and aliphatic or aromatic carboxylic acids are preferable. It is to be noted that the aluminium oxide component of the alumina sol has low electroconductivity and can provide good electroconductivity only in the presence of the electrolyte.

The amount of the electrolyte to be incorporated is preferably in the range of $10^{-4}$ to $10^{-2}$ mol per g. of aluminium oxide, but various amount thereof may be optionally used depending upon the valency number of the electrolyte selected.

The hydrophobic polymer which may be used in the second layer should be soluble in ordinary organic solvents and insoluble or sparingly soluble in a processing solution, and capable of forming a film. As the polymer, there may be mentioned a polymer or copolymer such as polystyrene, polymethylmethacrylate, polyvinylidene chloride, polyacrylonitrile or polyvinyl acetate; a cellulose derivative such as cellulose diacetate, cellulose triacetate, cellulose nitrate, ethyl cellulose or cellulose propionate; an acetal such as polyvinyl formal, polyvinyl acetal or polyvinyl benzal; and the like. Cellulose esters such as cellulose diacetate or cellulose triacetate and acetals such as polyvinyl acetal are preferred.

When the antistatic layer after coating the second layer has a low electroconductivity, for example, a surface specific resistance of not less than about $10^{10}$ l, there is the possibility of being insufficient for antisatic effect on a high speed light-sensitive silver halide photographic material. In such a case, it is preferable as the hydrophobic polymer in the second layer to employ a material in which static electricity is relatively difficult to generate, e.g. cellulose diacetate or polyvinyl acetal rather than a material in which static electricity is relatively easier to generate, e.g. polyvinyl acetate or polyvinylidene chloride. The hydrophobic polymer may be employed either alone or in admixture with other agents such as a matting agent, a lubricant, a plasticizer, an antifoaming agent or other additives. As the matting agent, one may use silicon oxide, aluminium oxide, magnesium oxide and other oxides with the grain size being $0.01 \sim 0.5\mu$, whereby the electric charge can be greatly lowered on various types of rollers, especially rubber rollers employed during the production of photographic films or in exposure machinery and automatic processing machine. As the lubricant one may use phosphoric acid esters or amine salts of a higher alcohol having 8 to 22 carbon atoms, palmitic acid, stearic acid or behenic acid, whereby abrasion resistance is effectively provided during production of photographic films and operation of a camera or printer.

A hydrophobic polymer may be incorporated as a binder into the first layer in the present photographic material. As the hydrophobic polymer, there may be mentioned, for example, cellulose diacetate, cellulose nitrate, ethyl cellulose, cellulose butyrate and a ternary copolymer of vinylidene chloride, methyl acrylate and acrylate, one or more of which may be combined with alumina sol. The amount of the hydrophobic polymer to be added in this case is preferably of $0.05 \sim 5$ g. per g. of the aluminium oxide in the alumina sol contained in the first layer.

When preparing the first layer, namely the electroconductive layer according to this invention, a coating composition is coated onto a support and then dried for adhesion.

The coating composition, contains the alumina dispersion which preferably has a concentration of about 0.1 to 1% by weight in view of processing and electroconductivity characteristics and may preferably contain a medium having a property to dissolve or swell the surface of a support to some extent. When the support is cellulose triacetate, one may use any optional combination of acetone, methanol, ethanol, dimethylformamide, dimethylacetamide, methyl cellosolve, ethyl cellosolve, methyl ethyl ketone, methyl isobutyl keton, benzene and the like. When the support is polyethylene terephthalate, one may optionally select and use those solvents recited in regard to the aforesaid cellulose triacetate support, and may also use phenol, methylene chloride, ehtylene chloride, dioxane, resorcin, catechol and the like. A coating composition may be prepared by the use of the above solvents and coated onto a support so as to be a solid content of about $5 \sim 500$ mg. of aluminium oxide in the form of the alumina sol per $m^2$ of a support.

When the support is polyethylene terephthalate, it is desirable to initially coat a subbing layer onto the support instead of the present electroconductive layer and then coat the present first layer onto the coated subbing layer. When coating a subbing layer, polyvinylidene chloride, copolymer of polyvinylidene chloride and acrylonitrile, copolymer of vinyl chloride and vinylidene chloride, copolymer of vinyl chloride and vinyl acetate, copolymer of vinyl chloride and methacrylate, copolymer of vinylidene chloride and methacrylate, polyglycidyl methacrylate, cellulose diacetate, cellulose triacetate, ethyl cellulose and the like either alone or in combination therewith may be dissolved in a suitable solvent and coated onto a support and then dried according to a known technique.

As the support for this invention, there may be mentioned, in addition to the above-named cellulose triacetate and polyethylene terephthalate, polycarbonate, polystyrene, polyolefin, polyethylene laminated paper and other available hydrophobic films and sheets.

When coating the hydrophobic polymer-containing layer, namely the second layer in this invention, the hydrophobic polymer may be dissolved in the same solvent as used for the coating composition of the first layer at a concentration of about $0.1 \sim 1\%$ by weight to produce the coating composition, which can be then coated onto the dried electroconductive layer and then dried.

Coating for both the first layer and the second layer may be easily accomplished by conventional methods such as roll-coating, spraying, curtain-coating, fountain-coating and so one. Coated layers may be dried by any conventional means.

In addition, the present electroconductive layer containing the electrolyte-containing alumina sol does not show any cracking and peeling-off when coated with the hydrophobic polymer-containing layer and it can be, therefore, said that the present first layer has a very satisfactory processisng ability.

Any type of light sensitive photographic layer may be used in this invention, which are for example, includes a light sensitive silver-halide photographic layer or a light sensitive polymer photographic layer and so on. In the above, the light sensitive silver halide photographic layer is more suitable for this invention.

This invention will be more fully illustrated by way of the following examples, but it should be noted that embodiments of this invention are not limited.

EXAMPLE 1

A cellulose triacetate film support, which had been coated with a known subbing layer, was coated over the reverse side thereof with a coating composition to provide the electroconductive layer having the following formulation at a rate of 1/50th of a liter of coating per $M^2$.

| | |
|---|---|
| Alumina sol AS-100 (available from Nissan Kogyo K.K. Japan; 10% alumina inorganic colloidal dispersion in water having a grain size of 50~100 mμ × 10 mμ; containing 0.18 g. of HCl per g. of alumina sol) | 40 g. |
| Cellulose diacetate | 2 g. |
| Acetone | 600 ml. |
| Methanol | 400 ml. |

The coated support was dried at 80° C. for 5 minutes and then coated thereon with a coating composition having the following formulation and containing the hydrophobic polymer as indicated below at a rate of 1/55th of a liter of coating per $M^2$.

| | |
|---|---|
| Cellulose diacetate | 5 g. |
| Acetone | 600 ml. |
| Methanol | 400 ml. |
| Fine grains of silica (average grain size of 0.2μ) | 2 g. |
| Behenic acid | 2 g. |

The coated support was dried at 80° C. for 5 minutes and then coated over the subbing layer with a silver halide emulsion layer for high speed color negative film. The sample thus prepared is named Sample No. 1.

EXAMPLE 2

A cellulose triacetate film support, which had been coated with a known subbing layer, was coated over the reverse side thereof with a coating composition to provide the electroconductive layer having the following formulation at a rate of 1/50th of a liter of coating per $M^2$.

| | |
|---|---|
| Alumina sol AS-100 | 40 g. |
| Acetone | 500 ml. |

-continued

| | |
|---|---|
| Methanol | 300 ml. |
| Methyl isobutyl ketone | 200 ml. |

The coated support was dried at 80° C., for 5 minutes and then coated with a coating composition having the following formulation and containing the hydrophobic polymer as indicated below at a rate of 1/55th of a liter pf coating per $M^2$.

| | |
|---|---|
| Polyvinylacetal | 10 g. |
| Methanol | 600 ml. |
| Acetone | 200 ml. |
| Methyl ethyl ketone | 200 ml. |
| Fine grains of silica (average grain size of 0.2μ) | 2 g. |

The coated support was dried at 80° C. for 5 minutes and then coated over the subbing layer with a high speed color reversal silver halide emulsion layer.

The sample thus prepared is named Sample No. 2.

EXAMPLE 3

A cellulose triacetate film support, which had been coated with a known subbing layer, was coated over the reverse side thereof with a coating composition to provide the electroconductive layer having the following formulation at a rate of 1/50th of a liter of coating per $M^2$.

| | |
|---|---|
| Alumina sol AS-100 | 40 g. |
| Acetone | 600 ml. |
| Methanol | 400 ml. |
| Cellulose diacetate | 3 g. |

The coated support was dried at 80° C. for 5 minutes and then coated with the same hydrophobic polymer protecting layer as used in Example 1. After drying, a high speed silver halide emulsion layer for indirect X-ray photography was coated over the subbing layer of the said support.

The sample thus prepared is named Sample No. 3.

EXAMPLE 4

A polyethylene terephthalate film support, which had been coated with a known subbing layer, was coated over the coated subbing layer with a coating composition to provide the electroconductive layer having the following formulation at a rate of 1/50th of a liter of coating per $M^2$.

| | |
|---|---|
| Alumina sol AS-100 | 40 g. |
| Methanol | 600 ml. |
| Ethylene chloride | 300 ml. |
| Phenol | 100 ml. |

The coated support was dried at 80° C. for 5 minutes and then coated with the same hydrophobic polymer protective layer as used in Example 1. After drying, a high speed silver halide emulsion layer was coated over the subbing layer of the said support.

The sample thus prepared is named Sample No. 4.

For comparative purposes, according to the Example 1 disclosed in Japanese Patent Publication No. 28937/1972 a coating composition having the following formulation was coated over the reverse side of a cellulose triacetate film support.

| | |
|---|---|
| 20% Aqueous solution of copolymer of maleic acid with styrene (50 : 50 in mole %) neutralized to pH 7 with sodium hydroxide | 12.5 ml. |
| Water | 37.5 ml. |
| Methanol | 150 ml. |
| Acetone | 700 ml. |
| 5% Acetone solution of cellulose diacetate | 100 ml. |

The coated support was dried at 80° C. for 5 minutes and then coated with a coating composition having the following formulation followed by drying.

| | |
|---|---|
| 5% Acetone solution of cellulose diacetate | 80 ml. |
| Acetone | 770 ml. |
| Methanol | 75 ml. |
| Butanol | 75 ml. |

The sample thus prepared is named Comparative Sample No. 1.

Further, following the same procedures as in the above Example 1 except that the hydrophobic polymer protective layer, i.e. the 2nd layer was omitted, a sample was prepared and named Comparative Sample No. 2.

EXAMPLE 5

A cellulose triacetate film support, which had been coated with a known subbing layer, was coated over the reverse side thereof with a coating composition to provide the electroconductive layer having the following formulation at a rate of 1/50th of a liter of coating per $M^2$.

| | |
|---|---|
| Alumina sol AS-200 (available from Nissan Kogyo K.K., Japan; 10% alumina inorganic colloidal dispersion in water having a grain size of 100 mμ × 10 mμ; containing 0.18 g. of acetic acid per g. of alumina) | 80 g. |
| Acetone | 600 ml. |
| Methanol | 400 ml. |

The coated support was dried at 80° C. for 5 minutes and then coated with the same hydrophobic polymer protecting layer as used in the above Example 1. After drying, a high speed silver halide emulsion layer for color negative film was coated over the subbing layer. The sample thus prepared is named Sample No. 5.

The Samples No. 1 ~ No. 5 and Comparative Samples No. 1 ~ No. 2 were evaluated for their characteristics as shown in the following examples.

EXAMPLE 6

Surface specific resistances of the Samples and Comparative Samples prepared according to the Examples and moist-conditioned at a relative humidity of 55% were measured before and after processing. Processing was conducted according to a conventional color development processing. Conditions of processing were developing at 38° C. for 3 minutes, bleaching at 38° C. for 6 minutes, washing at 38° C. for 3 minutes, fixing at 38° C. for 6 minutes, washing at 38° C. for 3 minutes and stabilizing at 38° C. for 3 minutes. The results are summarized in the following Table 1.

A developer having the following formulation was employed for the color development processing.

| | |
|---|---|
| Water | 800 ml. |
| Benzyl alcohol | 3.8 ml. |
| Sodium hexametaphosphate | 2.0 g. |
| Sodium sulfite (anhydrous) | 2.0 g. |
| Sodium carbonate (monohydrate) | 50.0 g. |
| Potassium bromide | 1.0 g. |
| Sodium hydroxide (as 10% aqueous solution) | 5.5 ml. |
| 4-Amino-3-methyl-N-(methylsulfonamidoethyl)-aniline 3/2 $H_2SO_4$ . monohydrate | 5.0 g. |
| Surfactant (1% aqueous solution of sodium dodecylbenzenesulfonate) | 0.5 ml. |
| Water to make | 1 l. |

TABLE 1

| | Surface specific resistance (55% RH) Before processing | Ω/cm² After processing |
|---|---|---|
| Sample No. 1 | $5.3 \times 10^9$ | $2.0 \times 10^{12}$ |
| Sample No. 2 | $8.7 \times 10^8$ | $4.0 \times 10^{12}$ |
| Sample No. 3 | $3.4 \times 10^9$ | $3.5 \times 10^{12}$ |
| Sample No. 4 | $6.0 \times 10^9$ | $5.3 \times 10^{12}$ |
| Sample No. 5 | $4.0 \times 10^{10}$ | $8.5 \times 10^{12}$ |
| Comparative Sample No. 1 | $7.2 \times 10^8$ | $10^{14}$ more than |
| Comparative Sample No. 2 | $5.3 \times 10^9$ | $5.5 \times 10^{13}$ |

EXAMPLE 7

Abrasion resistance, i.e. difficulty in abrasion of film was examined on all Samples.

Samples before and after processing were loaded into conventional patrones and empolyed for high speed photography with a still camera to investigate the degree of abrasion on the film surface.

To determine abrasion resistance during processing, the film surface was indented in a checkerboard pattern at the time of processing completion and before bleaching and thereafter strongly rubbed while moistened ten times with a rubber roller. Then, the peel degree of the film was observed and represented in terms of a ratio of the peeled checkerboard-patterned frames in a film to the whole checkerboard-patterned frames in a film. The results are summarized in the following Table 2.

TABLE 2

| | Abrasion resistance of film (before & after processing); film strength (during processing) | | |
|---|---|---|---|
| | Before processing* | During processing** | After processing* |
| Sample No. 1 | 1 | 0% | 1 |
| Sample No. 2 | 1 | 0% | 1 |
| Sample No. 3 | 1 | 0% | 1 |
| Sample No. 4 | 1 | 0% | 1 |
| Sample No. 5 | 1 | 0% | 1 |
| Comparative Sample No. 1 | 1 | 80% | 4 |
| Comparative Sample No. 2 | 5 | 0% | 5 |

[Remarks]

*:Ratings of abrasion before and after processing are as follows: 1-No abrasions, 2-Slight abrasions, 3-Some abrasions, 4-Considerable abrasions, 5-Many abrasions

**:Film strength during processing expressed in terms of a ratio of the peeled checkerboard-patterned frames

EXAMPLE 8

Each Sample was cut into rectangular sheets (each being 10 mm in length and 3.5 mm in width) and moist-conditioned in an atmosphere of a relative humidity of 80% for 24 hours. Each group of sheets was piled up so that the antistatic surface of a sheet and the emulsion surface of another sheet coated on the reverse side come into contact and a load of 500 g. was applied thereto from the top. Subsequently, each group was heated to 50° C. for 4 hours. Adhesivity was examined by peeling the contacted surfaces of sheets. The results are shown in the following Table 3.

EXAMPLE 9

Each Sample was loaded into a conventional patrone and employed for a high speed photography with a still camera in an atmosphere of 20° C. and a relative humidity of 20%. After ordinary developing, development of static marks was investigated. The results are also shown in the following Table 3.

TABLE 3

| | Adhesion resistance* | Static marks** |
|---|---|---|
| Sample No. 1 | 1 | 1 |
| Sample No. 2 | 1 | 1 |
| Sample No. 3 | 1 | 1 |
| Sample No. 4 | 1 | 1 |
| Sample No. 5 | 1 | 1 |
| Comparative Sample No. 1 | 3 | 1 |
| Comparative Sample No. 2 | 3 | 1 |

[Remarks]
*:Ratings of adhesion resistance are as follows: 1-No adhesion, 2-Rather weak adhesion, 3-Weak adhesion, 4-Rather strong adhesion, 5-Strong adhesion
**:Ratings of development of static marks are as follows: 1-Not observed, 2-Rather weakly developed, 3-Weakly developed, 4-Rather strongly developed, 5-Strongly developed

We claim:

1. A photographic material comprising a support having on one side (i) an alumina sol-containing layer comprising alumina-containing colloidal particles and an electrolyte, and (ii) a layer containing a hydrophobic polymer coated on said alumina sol-containing layer, and having a light-sensitive photographic layer on the other side of said support.

2. The photographic material of claim 1, wherein the average grain size of said colloidal particles ranges from 0.1 to 0.02$\mu$.

3. The photographic material of claim 1, wherein said electrolyte is an inorganic acid, an aliphatic carboxylic acid or an aromatic carboxylic acid.

4. The photographic material of claim 1, wherein said hydrophobic polymer is a cellulose ester or an acetal.

5. The photographic material of claim 2, wherein said aluminia sol-containing layer contains said colloidal particles in an amount between 5 and 500 mg. per square meter of said layer.

6. The photographic material of claim 1, wherein said alumina sol-containing layer contains said colloidal particles in an amount between 5 and 500 mg. per square meter of said layer.

7. The photographic material of claim 2 or claim 1, wherein said alumina sol-containing layer contains said electrolyte in an amount between $10^{-4}$ and $10^{-2}$ mol of electrolyte per gram of alumina in said layer.

8. The photographic material of claim 6, wherein said alumina sol-containing layer contains said electrolyte in an amount between $10^{-4}$ and $10^{-2}$ mol of electrolyte per gram of alumina in said layer.

* * * * *